United States Patent [19]

Kiyohara et al.

[11] Patent Number: 5,061,612

[45] Date of Patent: Oct. 29, 1991

[54] REFLECTIVE SUPPORT FOR PHOTOGRAPHY

[75] Inventors: Kazuto Kiyohara; Hiromitu Araki; Toshiaki Yamazaki; ' Ichiya Harada, all of Tokyo, Japan

[73] Assignee: Konica Corporation, Tokyo, Japan

[21] Appl. No.: 484,677

[22] Filed: Feb. 26, 1990

[30] Foreign Application Priority Data

Mar. 8, 1989 [JP] Japan ..... 1-55928

[51] Int. Cl.[5] ..... G03C 1/76

[52] U.S. Cl. ..... 430/533; 430/538; 428/324

[58] Field of Search ..... 430/533, 538; 428/324

[56] References Cited

U.S. PATENT DOCUMENTS

| | | | |
|---|---|---|---|
| 3,340,062 | 9/1967 | Hunter et al. | 430/533 |
| 4,665,013 | 5/1987 | Sach et al. | 430/538 |
| 4,847,149 | 7/1989 | Kiyohara et al. | 430/533 |

FOREIGN PATENT DOCUMENTS

| | | |
|---|---|---|
| 0182263 | 5/1986 | European Pat. Off. . |
| 0292120 | 11/1988 | European Pat. Off. . |
| 0327768 | 8/1989 | European Pat. Off. . |
| 1563592 | 3/1980 | United Kingdom . |

*Primary Examiner*—Jack P. Brammer

*Attorney, Agent, or Firm*—Frishauf, Holtz, Goodman & Woodward

[57] ABSTRACT

Disclosed is a reflective support for photography, comprising a polyester film containing titanium oxide particles, wherein the particle size distribution of the titanium oxide particles with particle sizes of 0.05 μm or more satisfies the formula shown below:

$$N/\gamma \geqq 50 \quad (I)$$

N: number of the titanium oxide particles with particle sizes of 0.05 μm within 10 Ξm × 10 μm area in a transmission type electronmicrography photographed on a film sliced into a thin strip of about 2,000 Å thick;

γ: the ratio of $d_{80}$ to $d_{20}$ when the particle distribution of the titanium oxide particles is measured by the above transmission type electronmicrography photographed:

$$\gamma = d_{80}/d_{20}$$

$d_{80}$, $d_{20}$: respective particle sizes (μm) when the integrated distribution of number of titanium oxide particles is 80% and 20%. Disclosed is also a photographic printing paper comprising the reflective support.

16 Claims, 1 Drawing Sheet

REFLECTIVE SUPPORT FOR PHOTOGRAPHY

BACKGROUND OF THE INVENTION

This invention relates to a reflective support for photography to be used in a reflective photographic element. Here, the reflective photographic element, as contrasted to the so-called transmission photographic element which projects a photographic image with transmitted light and utilizes its projected image, refers to one by use of an opaque material support having a photographic layer provided thereon, which is ordinarily a photographic element generally called printing paper for viewing directly the photographic image formed on said photographic layer with reflected light.

In the prior art, as the support for reflective photographic element, there have been generally used polyethylene-coated papers having polyethylene layers containing white pigment, etc. kneaded therein provided on base papers manufactured from pulp. However, in the reflective photographic element by use of a polyethylene-coated paper as the support, due to unevenness of the adjacent base paper support, coarse and ripple-like luster surface is obtained, whereby lightness and sharpness of the photographic image and beautifulness due to them is markedly impaired. Also, the both surfaces of the base paper of the support are coated with polyethylene thin films which do not allow water to permeate therethrough, but since the cut face of the base paper is not coated, penetration of developing processing solution, etc. occurred therefrom, thereby involving the drawback of coloration, etc.

As the method for cancelling the above drawback, there have been proposed some methods of employing only a thermoplastic resin film without use of a base paper for the support.

The present inventors disclosed in Japanese Unexamined Patent Publication No. 118746/1986 (the corresponding U.S. application is Ser. No. 945,207) a reflective photographic element comprising an emulsion coated on a film having its film thickness and whole visible light transmittance within specific ranges formed by addition of a titanium oxide subjected to surface treatment with a mean particle size of 0.1 to 0.5 m to a polyester. However, it was not still satisfactory with respect to whiteness.

Thus, it has been desired to develop a reflective photographic element by use of only a thermoplastic resin without use of base paper for the support, and also having sufficient whiteness.

SUMMARY OF THE INVENTION

An object of the present invention is to solve such problems and obtain a reflective photographic element, having lightness and sharpness of photographic images, and yet having sufficient whiteness without coloration by penetration of developing processing solution, etc.

The above problem is solved by a reflective support for photography, comprising a polyester film containing titanium oxide particles, wherein the particle size distribution of said titanium oxide particles with particle sizes of 0.05 μm or more satisfies the formula shown below:

$$N/\gamma \geqq 50 \quad \text{(I)}$$

N: number of the titanium oxide particles with particle sizes of 0.05 μm within 10 μm × 10 μm area in a transmission type electronmicrography photographed on a film sliced into a thin strip of about 2,000 Å thick;

γ: the ratio of $d_{80}$ to $d_{20}$ when the particle distribution of the titanium oxide particles is measured by the above transmission type electronmicrography photographed:

$$\gamma = d_{80}/d_{20}$$

$d_{80}$, $d_{20}$: respective particle sizes (μm) when the integrated distribution of number of titanium oxide particles is 80% and 20%.

DESCRIPTION OF PREFERRED EMBODIMENTS

Figure 1:
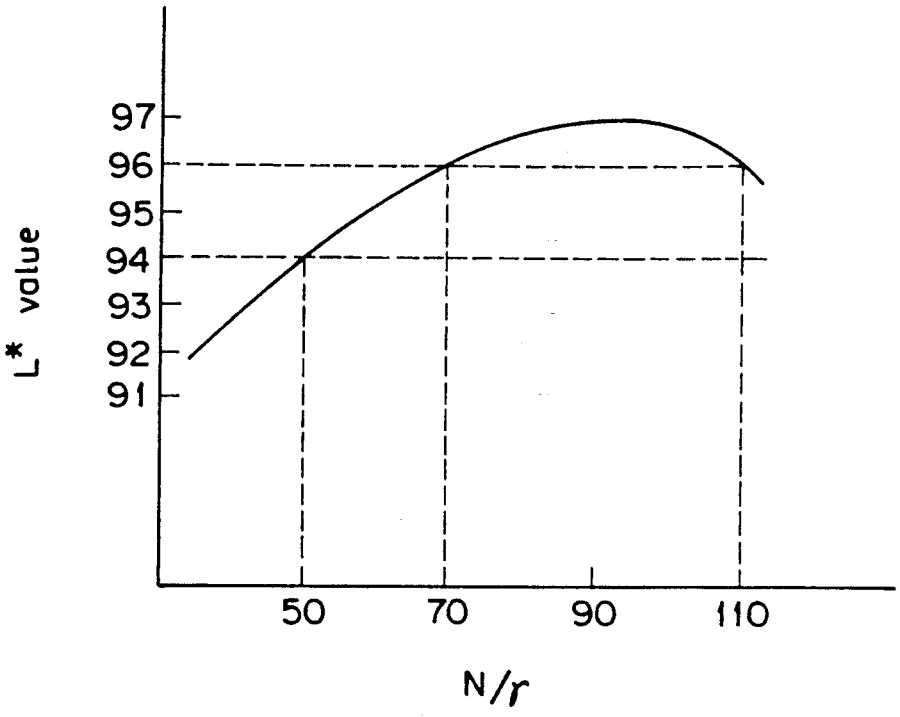
FIG. 1 is a graph showing the relationship between N/γ value and L* value.

As shown by the above formula (I), in the present invention, the titanium oxide ($TiO_2$) particles in the film is required to satisfy $N/\gamma \geqq 50$. For determining the values of N and γ in the formula, measurements as described below are performed.

The film is sliced by a ultramicrotome into a thin strip of 2,000 Å. During this operation, the film should be preferably embedded in an epoxy resin to be sliced cleanly. The above thin strip is placed in a transmission type electron microscope and photographed at a magnification of 10,000. Next, only the particle sizes of the particles having particle sizes of 0.05 μm or more among the $TiO_2$ particles in the electron micrograph photographed are subjected to measurement of the respective maximum diameters when projected in the vertical and horizontal direction by means of, for example, an image analyzer TVIP-2000 (manufactured by Nippon Abionics K.K.). However, it is preferable to select an image area to the extent which can measure the total number of particles of 2,000 or more. The particle size value is shown in a mean value of the both of respective maximum diameters when projected in the vertical direction and the horizontal direction. The number fraction in each particle size is determined with the total number of particles measured being made as 100%. The number fraction mentioned here is the ratio of the number of particles in each particle size occupied in the total number of particles. The respective number fractions are added from smaller ones, and the particle size when the integration becomes 20% is defined as $d_{20}$, and the particle size when 80% as $d_{80}$, and the value of their ratio $d_{80}/d_{20}$ is defined as γ.

In the measurement of the number of particles, "one particle" refers to, in addition to individual particles each having particle sizes of 0.5 μm or more, aggregates which are formed by aggregation of minute particles and have particle sizes of 0.5 μm or more. In the latter case, when the shape of respective minute particles forming one aggregate can be clearly recognized by the above electron micrograph and also these have particle sizes of 0.5 μm or more, each of these minute particles are counted as one particle.

Since the size of the image area and the total number of particles required for measurement preferably selected are known, the number of particles per 100 $\mu m^2$ is calculated from these, and this is defined as N.

Between N/γ and whiteness, there is an intimate relationship, and at N/γ less than 50, whiteness is completely deficient, while if it is greater than 110, whiteness will be dropped. Hence, $N/\gamma$ should be preferably 50 or higher, preferably $N/\gamma \geqq 70$, more preferably $70 \leqq N/\gamma$ 110.

The titanium oxide with a mean particle size of 0.1 to 0.5 μm to be used in the present invention may be either one of the rutile type and the anatase type, but for blue-tinted tone, the anatase type may be more preferably employed.

Since the refractive index of the titanium oxide to be used in the present invention (n=2.5 to 2.75) is extremely greater as compared with the refractive index of the polyester to be used in the present invention (for example, the refractive index of polyethylene terephthalate is about 1.66), when used in a support for reflective photographic element, it is excellent in optical reflection ability, and the resolution of the photographic image obtained becomes excellent.

In the present invention, the titanium oxide can be applied with the surface treatment. The surface treatment refers to the inorganic treatment which comprises depositing one or two or more kinds selected from hydroxides, hydrated oxides, phosphates or basic sulfates, etc. of Al, Ce, Mg, Ti, Sb, Si, Sn, Zn, Zr, etc. and/or the organic treatment which adsorbs aliphatic metal salts, various coupling agents, alcohols, amines, siloxane polymers, various ester compounds, phosphoric acid compounds, etc. on the titanium oxide surface.

The titanium oxide should be preferably subjected to classification for removal of coarse particles before addition to the polyester resins. Classification may be either the wet system or the dry system.

The wet system classification treatment removes particles with a certain particle size or more by separation by utilizing the difference in sedimentation speed according to the particle size by way of suspending the titanium oxide into a liquid such as water which does not dissolve the titanium oxide, and depending on the manner of sedimentation, may be classified into the natural sedimentation method and the centrifugal precipitation method. In the present invention, both methods can be employed, but the natural sedimentation method may be preferably employed for high precision and simple device. Also, the suspension concentration is not particularly limited, but sedimentation may be practiced generally at a concentration ranging from 100 to 700 g/liter. Also, in the suspension, a dispersing agent such as sodium hexametaphosphate, etc. can be added.

The dry system classification treatment refers to the method of removing particles with a certain particle size or more by separation by utilizing the difference in behaviors due to the particle size in a gas such as air, etc. Air elutriation, air separator, cyclone, etc. can be used.

In the present invention, the wet system classification treatment may be preferably used rather than the dry system from such points as precision of classification, easiness of handling, etc.

The wet system pulverization treatment refers to the operation of pulverizing the titanium oxide in a liquid such as water, etc. which cannot dissolve the titanium oxide.

Generally, a pulverizer such as ball mill, vibration mill, sand mill, etc. may be used. Among them, the sand mill type is effective, and glass beads, alumina beads, zirconia beads, Ottawa sand, etc. may be used as the medium and there are many kinds of commercially available machines.

The residence time in the pulverizer may be suitably about 3 to 30 minutes.

Either one or both of the wet system or the dry system classification treatment and the wet system pulverization treatment may be performed.

In the present invention, the dry system or the wet system classification treatment and/or the wet system pulverization treatment may be performed either before or after the surface treatment of the titanium oxide, or also when the surface treatment performs both the inorganic treatment and the organic treatment, may be practiced between the inorganic treatment and the organic treatment.

The polyester to be used in the present invention may include thermoplastic resins consisting only of polyester, as a matter of course, and also those having other polymers, additives, etc. added within the range which does not practically change the resin characteristics of the polyester which is the main component.

As the polyester to be used in the present invention, there may be included polymers of condensates between aromatic dicarboxylic acids such as terephthalic acid, isophthalic acid, phthalic acid, naphthalene dicarboxylic acid, etc. and glycols such as ethylene glycol, 1,3-propane diol, 1,4-butane diol, etc., for example, polyethylene terephthalate, polyethylene 2,6-dinaphthalate, polypropylene terephthalate, polybutylene terephthalate, etc. or copolymers of these. As the polyester to be used in the present invention, polyethylene terephthalate (hereinafter abbreviated as PET) is preferred. PET films do not permit water to permeate therethrough, having excellent smoothness, excellent mechanical characteristics such as tensile strength, bursting strength, etc., excellent dimensional stability such as heat shrinkage, etc., and further excellent chemical resistance during developing processing.

The polyester to be used in the present invention should preferably have an intrinsic viscosity preferably of 0.4 to 1.0, more preferably 0.5 to 0.8, as measured at 20° C. in a solvent mixture of phenol/1,1,2,2-tetrachloroethane (60/40 weight ratio).

In the present invention, the ratio of the titanium oxide contained in the polyester may be preferably 10 to 50 parts by weight, more preferably 15 to 30 parts by weight, of the titanium oxide based on 100 parts by weight of the polyester, from the points of whiteness, stretchability, etc. of the support film, and is added so that the whole visible light transmittance may be 20% or less.

In the present invention, the titanium oxide can be used in combination with one or two or more kinds of inorganic pigments generally used as white pigments in this field of the art, such as zinc oxide, barium sulfate, silica, talc, calcium carbonate, etc. However, these white pigments which can be used in combination should not exceed 10 parts by weight based on 100 parts by weight of the polyester of the present invention.

In the present invention, the method of filling the above-mentioned titanium oxide in the polyester is not particularly limited, provided that the condition of $N/\gamma \geqq 50$ is satisfied. For example, kneading into the polyester may be mentioned. In that case, kneading should be preferably performed under the molten state of the polyester.

In the present invention, as the kneading machine for kneading and dispersing the titanium oxide in the polyester, there may be employed extruders having rotor or blade for kneading, co-directional or counter-directional rotation type biaxial kneading extruders, continuous kneading machines such as monoaxial type continuous kneaders, etc., or batch system kneading machines such as three rolls, Banbury mixers, Henscel mixers, kneaders. Among them, since kneading can be performed continuously while applying strong shearing force, co-directional rotation type continuous biaxial kneading machines may be preferably used.

Also, it is possible to use the method in which $TiO_2$ is dispersed in a polyhydric alcohol such as ethylene glycol, etc., and adding the slurry into a polyester polymerization system.

In the present invention, the polyester composition obtained by the above-mentioned kneading may be once formed into pellets before provided for film molding, or alternatively provided under the molten state as such for film molding. Also, in either method, molding may be conducted with the pigment concentration as such, or a composition with higher pigment concentration, namely the so-called master batch may be prepared, and this may be diluted before molding.

For film molding, the polyester composition obtained by kneading may be extruded under the molten state through a slit die, allowed to contact a quenched surface of a rotatory drum, etc. to form an amorphous sheet and stretched successively in monoaxial direction of the longitudinal or lateral direction or biaxially at the same time at a temperature range from the glass transition temperature (Tg) of the polyester of the present invention to 130° C. In this case, for satisfying the mechanical strength and the dimensional stability of the film support, stretching should be preferably performed at an area ratio ranging from 4 to 16-fold, more preferably from 6 to 12-fold. Subsequent to stretching, thermal fixing and thermal relaxation may be preferably effected.

Also, during film fabrication, it is preferable to perform filtration with a filter of appropriate grade.

The film thickness of the film support of the present invention obtained as described above may be preferably 50 to 300 μm, more preferably 75 to 250 μm. If it is thinner than 50 μm, the nerve as the support is weak and wrinkles are readily formed. On the other hand, if it exceeds 300 μm, the thickness is too thick, thereby causing such shortcoming as inconvenient handling, etc. to occur.

In the film support of the present invention, other additives conventionally used, such as fluorescent brighteners, dyes, UV-ray absorbers, antistatic agents, etc. can be contained within the range which does not impair the object of the present invention.

On the film support of the present invention which has been molded and made opaque and white as described above, at least one light-sensitive silver halide photographic emulsion layer is provided by coating. In this case, if necessary, prior to coating of the light-sensitive silver halide photographic emulsion, a surface activation treatment such as corona charging, etc. may be applied and/or a subbing layer may be provided by coating.

As the coating method of the light-sensitive silver halide photographic emulsion layer, extrusion coating and curtain coating which can coat two or more layers at the same time are particularly useful. Also, the coating speed can be chosen as desired, but a speed of 50 m/min. or faster is preferable in productivity.

The reflective photographic element of the present invention is applicable to all of the photographic elements using supports, and is not limited in use such as for black-and-white or for color, etc. It is applicable also in photographic constituent layers such as light-sensitive silver halide photographic emulsion layer, intermediate layer, protective layer, filter layer, back coat layer, etc. without particular limitation of layer number and layer order.

The light-sensitive silver halide photographic emulsion is a conventional silver halide emulsion layer and, for example, silver chloride, silver bromide, silver chlorobromide, silver iodobromide, silver chloroiodo-bromide emulsions, etc. can be preferably used. Also, in this layer, a coupler for making a color image can be also contained, and as the binder, hydrophilic polymeric substances other than gelatin, such as polyvinyl alcohol, polyvinyl pyrrolidone, etc. can be also contained. Further, the above-mentioned silver halide emulsion layer can be also sensitized in the light-sensitive wavelength region with cyanine dyes, melocyanine dyes, etc., and also other various additives for photography, for example, antifoggants, chemical sensitizers by use of gold, sulfur, etc., film hardeners, antistatic agents, etc. can be preferably added. Therefore, also developing processing of the reflective photographic element of the present invention is effective for either developing processing for black-and-white or developing processing for color.

The present invention is described in detail below by referring to Examples, but the present invention is not limited by these embodiments at all.

EXAMPLE 1

The anatase type titanium oxide of a particle size $d_{50}$ of 0.20 μm with 50% of the integrated distribution of the number of particles was formed into an aqueous slurry with a concentration of 400 g/liter, and left to stand for a predetermined period of time according to the natural sedimentation method. Coarse particles of 1 μm or more were removed.

Subsequently, the surface of the titanium oxide particle was treated by coating with hydrated alumina by adding an aqueous aluminum sulfate solution into the suspension, and then adding an aqueous caustic soda solution. The treatment amount is 1.0% by weight as calculated on $Al_2O_3$ based on the titanium oxide weight.

Next, into the alumina-coated titanium oxide suspension was added an aqueous solution of polydimethyl siloxane so that a treatment amount of polydimethyl siloxane may become 0.6% by weight based on the titanium oxide weight, followed by filtration and drying.

Twenty parts by weight of the titanium oxide thus obtained and 80 parts by weight of a polyethylene terephthalate having an intrinsic viscosity of 0.68 were melted and kneaded by means of a co-directional rotation type biaxial kneading extruder (ZCM 53/60 manufactured by Automatic) under the following kneading conditions, followed by pelletization.

| Kneading conditions: | |
|---|---|
| Screw rotation number: | 160 rpm |
| Barrel set temperature: | Root portion 300° C., Tip portion 300° C., Central portion 200° C. |
| First feeding port (PET): | 20 kg/H |
| Second feeding port (TiO2): | 20 kg/H |
| Third feeding port (PET): | 60 kg/H |

Also, behind the first feeding port and behind the third feeding port are provided vent holes, through which evacuation to about 1 Torr was effected.

The PET resin was formed into columnar pellets of about 3 mm, previously vacuum dried at 170° C. for 6 hours, then melted by the extruder and extruded through a slit die onto a quenched rotatory drum to form an amorphous sheet with a film thickness of 1.4 mm, stretched at 95° C. in the longitudinal direction to 2.6-fold and at 110° C. in the lateral direction to 3.0-fold before thermal fixing at 210° C., followed finally by 0.5% relaxation in the lateral direction and then post-cooling, to give a white opaque film support of 180 μm.

The whole visible light transmittance of this film was found to be 5.0%.

The film was coated with a subbing layer comprising a ternary copolymer of styrene-butadiene-maleic anhydride, then applied with corona discharging, and a gelatin-silver halide photographic emulsion conventionally used for color photographic printing paper was provided by coating to a dry film thickness of 15 μm thereon to prepare a reflective photographic element sample.

Whiteness and resolution of this sample were measured as described below and N/γ, as described above.

Measurement methods

Whiteness measurement

For the green base before emulsion coating and subbing, spectral reflectance at 380 to 780 nm was measured by a color analyzer Model 607 (manufactured by Hitachi K.K.), the three stimulative values were determined according to JIS-Z-8722 (1982), and further the L* value was calculated according to the method of CIE and defined as whiteness.

Resolution measurement

After a dense line chart for measurement of resolution was printed on the reflective photographic element sample and subjected to exposure, developing processing was performed in conventional manner, the optical density difference of the dense line printed image was measured by a microdensitometer PDM-5 (manufactured by Konica K.K.), and the value represented by the following formula is defined as resolution.

$$\text{Resolution} = \frac{\text{Density difference between } D\text{max and } D\text{min of dense line printed image of 5 lines/mm}}{\text{Density difference between } D\text{max and } D\text{min of dense line printed image of 0.1 line/mm}} \times 100$$

Comparative example 1

Kneading of 20 parts by weight of the anatase type $TiO_2$ applied with no surface treatment and 80 parts by weight of PET used in Example 1 was performed in the same manner as in Example 1 except for changing the kneading conditions as shown below.

| Kneading conditions: | |
|---|---|
| Screw rotation number: | 300 rpm |
| Barrel set temperature: | Root portion 300° C.<br>Central portion 300° C.,<br>Tip portion 300° C. |
| First feeding (PET): | 20 kg/H |
| Second feeding ($TiO_2$): | 20 kg/H |
| Third feeding port (PET): | 60 kg/H |
| Vent: | 20 Torr |

The pellets obtained were molded into a film and the emulsion was coated thereon in the same manner as described in Example 1, followed by determination of L* value and resolution.

The results of measurements as described above are shown in Table 1.

TABLE 1

| | L* value | Resolution (%) | N/γ | Remarks |
|---|---|---|---|---|
| Example 1 | 96.5 | 68 | 81 | Invention |
| Comparative example 1 | 92.5 | 64 | 44 | Out of invention |

As is apparent from Table 1, in Example 1 according to the present invention, both whiteness and resolution exhibited good results as compared with Comparative example 1.

The resolution which have been obtained by conventional resin coated papers are about 50%. Although the resolution can be improved by use of a white PET employing $TiO_2$, the improvement is limited to some extent. However, it is found that the resolution can be further improved by the present invention.

EXAMPLE 2

Kneading of 20 parts by weight of the anatase type $TiO_2$ and 80 parts by weight of PET used in Example 1 was performed so that various values of N/γ could be obtained by changing variously the kneading conditions, for example, screw rotational number, set temperatures, feeding amounts of $TiO_2$ or PET and vent pressure.

The respective pellets obtained were each formed into a film and the emulsion was coated thereon similarly as described in Example 1, followed by determination of L* value. An L* value of 94 or more is usable, and an L* value of 96 or more is preferable. The results are shown in FIG. 1.

As described in detail above, according to the present invention, there could be provided a reflective photographic element having lightness and sharpness of photographic image, and yet sufficient whiteness without coloration by penetration of developing processing solution, etc.

What is claimed is:

1. In a reflective photographic element comprising a reflective support comprising a polyester film containing titanium dioxide particles, and carrying a light-sensitive silver halide photographic emulsion layer, the improvement wherein the titanium oxide particles, have a particle size distribution consisting essentially of particle sizes of 0.05 μm or more satisfying the formula shown below:

$$110 \geqq N/\gamma \geqq 50 \quad (I)$$

wherein

N is the number of the titanium oxide particles with particle sizes of 0.05 μm or more within a 10 μm × 10 μm area of the reflective support;

γ is the ration of $d_{80}$ to $d_{20}$ $d_{20}$ is the particle diameter measured for particles in the distribution of particle sizes wherein 20% of the particles have a smaller diameter, and $d_{80}$ is the particle diameter measured for particles in the distribution of particle sizes wherein 80% of the particles have a smaller diameter, and wherein the titanium dioxide is present in an amount of 10 to 50 parts by weight based on 100 parts by weight polyester.

2. The photographic element according to claim 1, wherein the value of $N/\gamma$ satisfies the relation of $N/\gamma \leqq 70$.

3. The photographic element according to claim 2, wherein the value of $N/\gamma$ satisfies the relation of $70 \leqq N/\gamma 110$.

4. The photographic element according to claim 1, wherein the polyester is at least one polymer of condensates between aromatic dicarboxylic acids and glycols, and copolymers of these.

5. The photographic element according to claim 4, wherein the aromatic dicarboxylic acids are at least one selected from the group consisting of terephthalic acid, isophthalic acid, phthalic acid and naphthalene dicarboxylic acid, and the glycols are at least one selected from the group consisting of ethylene glycol, 1,3-propane diol and 1,4-butane diol.

6. The photographic element according to claim 5, wherein the polyester is at least one selected from the group consisting of polyethylene terephthalate, polyethylene 2,6-dinaphthalate, polypropylene terephthalate and polybutylene terephthalate.

7. The photographic element according to claim 6, wherein the polyester is polyethylene terephthalate.

8. The photographic element according to claim 1, wherein the polyester has an intrinsic viscosity of 0.4 to 1.0, as measured at 20° C. in a solvent mixture of phenol/1,1,2,2-tetrachloroethane (60/40 weight ratio).

9. The photographic element according to claim 8, wherein the polyester has an intrinsic viscosity of 0.5 to 0.8, as measured at 20° C. in a solvent mixture of phenol/1,1,2,2-tetrachloroethane (60/40 weight ratio).

10. The photographic element according to claim 1, wherein the titanium oxide is contained in an amount of 15 to 30 parts by weight based on 100 parts by weight of the polyester.

11. The photographic element according to claim 1, wherein the titanium oxide is added with at least one selected from the group consisting of zinc oxide, barium sulfate, silica, talc and calcium carbonate, in an amount of not more than 10 parts by weight based on 100 parts by weight of the polyester.

12. The photographic element according to claim 1, wherein the thickness of the support is 50 to 300 μm.

13. The photographic element according to claim 12, wherein the thickness of the support is 75 to 250 μm.

14. The photographic element according to claim 1, wherein the support has a whole visible light transmittance of 20% or less.

15. The photographic element according to claim 1, wherein the titanium dioxide particles are anatase type.

16. The photographic element according to claim 1, wherein the titanium dioxide particles have been subjected to classification.

* * * * *